US005423621A

United States Patent [19]

Russell

[11] Patent Number: 5,423,621

[45] Date of Patent: Jun. 13, 1995

[54] GARBAGE DISPOSAL CLEANING DEVICE

[76] Inventor: Lisa R. Russell, 400 15th Ave., Altoona, Iowa 50009

[21] Appl. No.: 282,155

[22] Filed: Jul. 28, 1994

Related U.S. Application Data

[63] Continuation of Ser. No. 976,953, Nov. 16, 1992, abandoned.

[51] Int. Cl.[6] ..... A46B 11/00

[52] U.S. Cl. ..... 401/9; 15/160; 15/164; 15/248.1; 401/15; 401/284

[58] Field of Search ..... 15/160, 164, 248.1; 401/15, 9, 279, 284; 4/255.11, 255.05

[56] References Cited

U.S. PATENT DOCUMENTS

| | | | |
|---|---|---|---|
| 797,343 | 8/1905 | Caddell | 401/279 |
| 1,332,033 | 2/1920 | Edwards | 15/248.1 |
| 2,358,252 | 9/1944 | Rowan | 15/160 X |
| 2,629,121 | 2/1953 | Petre | 15/164 X |
| 2,792,579 | 5/1957 | Roy | 15/164 X |
| 3,025,549 | 3/1962 | Turner et al. | 15/248.1 X |
| 3,862,461 | 1/1975 | Bucklitzsch | 15/164 |
| 4,174,548 | 11/1979 | Dunn | 4/255.11 X |
| 4,458,368 | 7/1984 | Webb | 4/255.11 |

FOREIGN PATENT DOCUMENTS

| | | | |
|---|---|---|---|
| 121610 | 7/1946 | Australia | 4/255.05 |
| 233961 | 9/1987 | European Pat. Off. | 4/255.11 |
| 1045017 | 6/1953 | France | 15/164 |
| 644531 | 9/1962 | Italy | 15/248.1 |

*Primary Examiner*—Steven A. Bratlie

[57] ABSTRACT

A garbage disposal cleaning device having a foldable and/or compressible splatter-guard to shield and prevent splattering of liquid and solid material when the device is being used. The handle of the garbage disposal cleaning device can be bent to make rotating the device easier, while the use of semi-soft non-abrasive bristles allows cleaning a garbage disposal unit without abrasive damage. The bristles can be specially contour-shaped to make cleaning of the garbage disposal unit and the surrounding drain more effective.

2 Claims, 4 Drawing Sheets

GARBAGE DISPOSAL CLEANING DEVICE

This application is a continuation of application Ser. No. 07/976,953, filed Nov. 16, 1992, now abandoned.

BACKGROUND OF THE INVENTION

1. Field of the Invention

The present invention relates generally to cleaning devices, and more particularly, to a device constructed for use in cleaning garbage disposal units without splattering and without damage to the disposal units.

2. Description of the Prior Art

Cleaning devices in the form of brushes and other wiping apparatuses are well known in the prior art.

Also, special devices have been constructed for plunging and/or pushing garbage materials into and through garbage disposal units. For example, design U.S. Pat. No. D 274,273 to Auerbach discloses a combined garbage disposal plunger and brush. Design U.S. Pat. No. D 292,835 to Schaber shows a garbage pusher while utility U.S. Pat. Nos. 4,397,761 to Loos and 3,765,275 to Johnson disclose other garbage pushers for garbage disposal units.

Unfortunately, when using devices such as those described above, typically dirty water and other solid/-liquid combinations splatter upward often spraying the user and their clothes as well as the nearby countertop and the floor.

Thus, while the foregoing body of prior art indicates it to be well known to use pushing and brushing devices for garbage disposal units, the prior art described above does not teach or suggest a garbage disposal cleaning device which may be used by individuals without the undesired splattering described above. The foregoing disadvantages are overcome by the unique garbage disposal cleaning device of the present invention as will be made apparent from the following description thereof. Other advantages of the present invention over the prior art also will be rendered evident.

SUMMARY OF THE INVENTION

To achieve the foregoing and other advantages, the present invention, briefly described, provides a garbage disposal cleaning device having a foldable and/or compressible and/or flexible splatter-guard. The handle of the garbage disposal cleaning device can be bent to make rotating the device easier, while the use of semi-soft non-abrasive bristles allows cleaning a garbage disposal unit without abrasive damage. The bristles can be specially contour-shaped to make cleaning of the garbage disposal unit and the surrounding drain more effectively by increasing the size of the lowest bristles.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved garbage disposal cleaning device which has all of the advantages of the prior art and none of the disadvantages.

It is another object of the present invention to provide a new an improved garbage disposal cleaning device which may be easily and efficiently manufactured and marketed.

It is a further objective of the present invention to provide a new and improved garbage disposal cleaning device which is of durable and reliable construction.

An even further object of the present invention is to provide a new and improved garbage disposal cleaning device which is susceptible of a low cost of manufacture with regard to both materials and labor, and which accordingly is then susceptible of low prices of sale to the consuming public, thereby making such garbage disposal cleaning device available to the buying public.

Still yet a further object of the present invention is to provide a new and improved garbage disposal cleaning device having a foldable/compressible splatter-guard.

It is still a further object of the present invention is to provide a new and improved garbage disposal cleaning device having a specially contour constructed bristle pattern to enable more effective cleaning.

Still a further object of the present invention is to provide a new and improved garbage disposal cleaning device having semi-soft non-abrasive bristles which thoroughly clean a garbage disposal unit without doing any damage to the garbage disposal unit.

Even still a further object of the present invention is to provide a new and improved garbage disposal cleaning device which removes stagnant bacterial build-up and eliminates the foul and unpleasant odors caused by the bacterial build-up.

Yet still a further object of the present invention is to provide a new and improved garbage disposal cleaning device with a bent handle making rotation of the garbage disposal cleaning device easier.

Yet even still a further object of the present invention is to provide a new and improved garbage disposal cleaning device with a bent handle having a finger-hole for making rotation of the garbage disposal cleaning device easier.

Yet still even a further object of the present invention is to provide a new and improved garbage disposal cleaning device with a bent handle and a hand-grip for making rotation of the garbage disposal cleaning device easier.

Even yet still a further object of the present invention is to provide a new and improved garbage disposal cleaning device with a bent handle and a spin-knob for making rotation of the garbage disposal cleaning device easier.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved garbage disposal cleaning device embodying the principles and concepts of the present invention will be described.

Figures 1, 2:
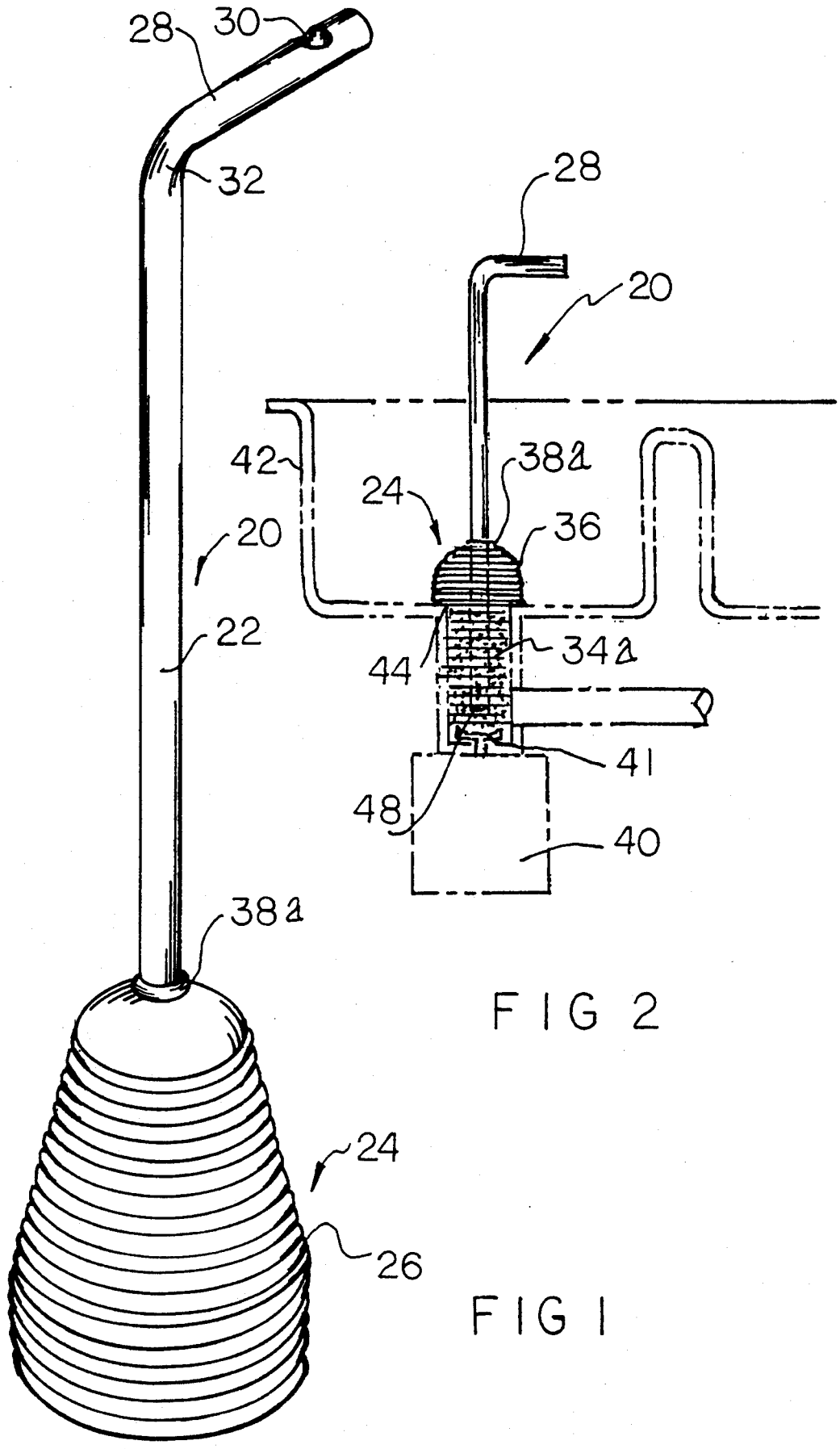
FIG. 1 is a perspective view showing the first preferred embodiment of the garbage disposal cleaning device of the present invention.
FIG. 2 is a partial cross-sectional view of the embodiment of the garbage disposal cleaning device of FIG. 1 in place in a sink having a garbage disposal unit.

Turning initially to FIGS. 1–4, there is shown a first exemplary embodiment of the garbage disposal cleaning device of the invention generally designated by reference numeral 20. In its preferred form, garbage disposal cleaning device 20 comprises generally an elongated shaft 22 which is bent at point 32 to form a handle 28. The shaft can be one unitary piece as preferred or made up of a series of pieces. A finger hole 30 is drilled in the handle to make rotation of the shaft, and therefore rotation of the entire garbage disposal cleaning device 20, easy. A splatter-guard (or boot) 24 is fixed to the shaft 22. The splatter-guard 24 is preferably constructed similarly to a rubber gear-shifter boot and is somewhat cone-shaped. The splatter-guard 24 may be constructed of a flexible and/or compressible and/or a foldable material, but it is preferably constructed of a compressible, flexible and foldable material such as, and preferably rubber. The splatter guard 24 is held in position by a pair of ledges 38*a* and 38*b* (only 38*a* is shown in FIGS. 1 and 2, see FIG. 3 to see ledge 38*b*), the ledges 38*a* and 38*b* preferably permanently fixed to the shaft 22. In FIG. 1 the splatter-guard 24 is shown in its fully extended (and/or non-compressed and/or unfolded) position 26.

Figure 3:
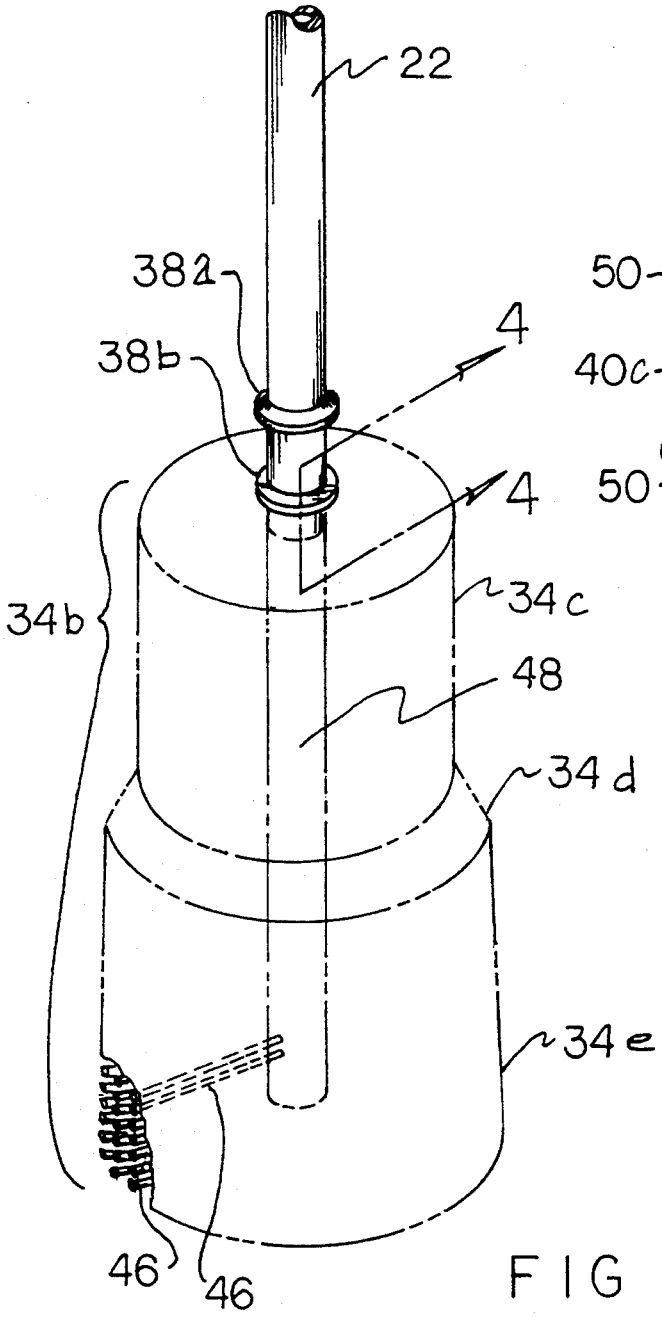
FIG. 3 is a perspective partially cross-sectional view of the preferred embodiment of the brush pattern of the garbage disposal cleaning device of the present invention.

In FIG. 2 the garbage disposal cleaning device 20 of the preferred embodiment is shown in place for cleaning a garbage disposal unit 40 with blade 41 extending up into the drain pipe. The garbage disposal cleaning device 20 is shown with the splatter-guard 24 in a compressed and folded position 36. With the guard 24 in its compressed position 26, the lower section 48 of shaft 22 is revealed. The cleaning surface of the preferred embodiment of the present invention utilizes bristles 46 (see FIG. 3) which are formed into a bristle pattern. The preferred fully extended bristle pattern 34*b* is shown in FIG. 3. In FIG. 2 the bristle pattern preferably originally like that of FIG. 3 is shown by reference numeral 34*a* after being compressed inside the drain 44 leading to the garbage disposal unit 40.

In FIG. 3, the preferred bristle pattern 34*b*, which covers lower section 48 of shaft 22, is shown with the largest bristles 34*e* nearest the bottom, progressively smaller bristles 34*d* which form a sloped shape immediately above the large bristles 34*e*, and the smallest bristles 34*c* immediately above the progressively smaller bristles 34. Individual bristles 46 are shown in the partially cutaway lower left corner of FIG. 3.

This bristle pattern is preferred because it puts a large number of long bristles 34*e* near the garbage disposal unit 40 to give a large cleaning surface. Also, the shorter bristles are near the top where the semi-cone shape of the splatter guard 24 is smallest, leaving the least amount of clearance for the bristles. The bristles 46 should also be oversized in length so that the bristle brush formed on the garbage disposal cleaning device 20 can be used with virtually any size drain hole and any size garbage disposal unit.

Figure 4:
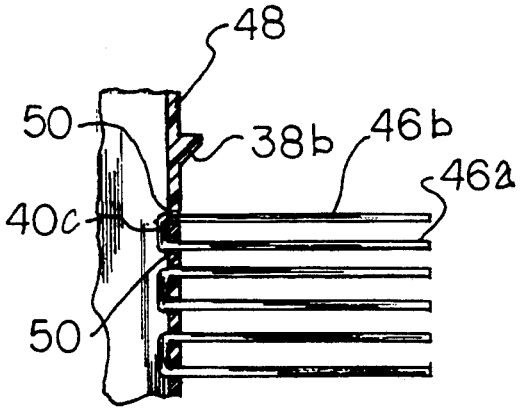
FIG. 4 is a cutaway cross-sectional view of the bristle detail of the preferred embodiment of the garbage disposal cleaning device of the present invention taken along lines 4—4 of FIG. 3.

FIG. 4 shows a cutaway section along lines 4—4 of FIG. 3. In the preferred construction, two bristles 46*a* and 46*b* are formed by a single strand of bristle material. The bristle material extends outward through a pair of small holes 50 in the lower section 48 of the shaft 22 to form a pair of bristles 46*a* and 46*b*, the bristle material bent around the lower section 48 as shown by reference numeral 46*c*.

Use of the garbage disposal cleaning device 20 of the present invention is very simple. Referring particularly now to FIG. 3, the garbage disposal cleaning device is inserted into the sink 42 such that the lower section 48 of the shaft with the bristles 46 passes through drain 44 to the garbage disposal unit 40. As the bristles 46 enter the drain 44 they compress as shown at reference numeral 34*a*, with the bristles contacting and rubbing against the sides of the drain 44 and the garbage disposal unit 40. As the lower section 48 enters the drain 44, the splatter-guard 24 contacts the bottom of the sink 42 surrounding the drain 44. As the lower section passes through the drain, the splatter-guard 24 pushes against the bottom of the sink 42 surrounding the drain 44, which causes the splattering-guard 24 to compress and fold into the shape 36 shown in FIG. 2. The flexibility of the splatter guard 24 enables it to effectively seal off the drain 44 from the outside environment.

After the garbage disposal cleaning device 20 is in place down to the garbage disposal unit 40, the shaft 22 is gripped by the user with one hand while the handle 28 is pushed or pulled such that the handle rotates around bend 32 causing the shaft 22 and the attached bristles 34*a* to rotate around the central axis of the shaft 22. The bristles 34*a* are in contact with the walls of the drain 44 and also in contact with the garbage disposal unit 40 and the rotating motion loosens, wipes and cleans the inside of the drain and the disposal. This cleaning removes bacterial build-up thus eliminating the foul and unpleasant odors associated with the bacterial build-up. Even if an up and down or other cleaning motion is imparted upon the cleaning device, the flexibility and expendability characteristics of the splatter guard 36 keep splatter from the drain area sealed inside the guard 36 shielding the outside environment from the splatter.

The compressed splatter-guard 36 provides an effective covering over the drain to prevent any splattering of liquid and solid material.

The preferred dimensions for the garbage disposal cleaning device is 24 inches in height with a 3 inch handle. Of course a garbage disposal cleaning device in accordance with the present invention could have any dimensions and those above are simply the preferred dimensions.

Figure 5:
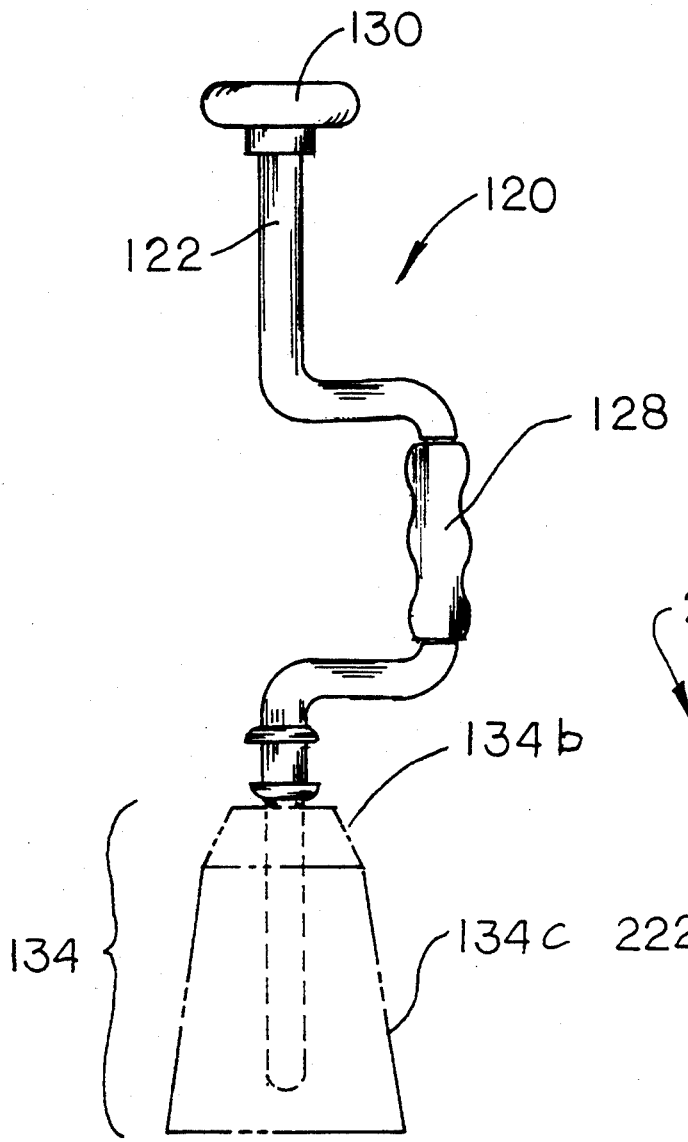
FIG. 5 is a side, partly cross-sectional view of the second preferred embodiment of the garbage disposal cleaning device of the present invention.

A second preferred embodiment of the garbage disposal cleaning device 120 of the present invention is shown in FIG. 5 with the splatter-guard removed to show the details of the pattern of the bristles 134 underneath. The splatter-guard that would be used would preferably be the same as that used in the first embodiment. In this second embodiment, the primary differences are the shape of the pattern of the brush bristles 134 and the shape of the shaft 122. The pattern of the brush bristles 134 is divided into two immediately adjacent and progressively increasing in bristle size (from top to bottom) sections 134*b* and 134*c*. The shaft 122 is shaped like a typical hand drill and operates in much the same way. A spin handle 128 is pushed or pulled to rotate the garbage disposal cleaning device by the user tightly gripping the handle 128 with one hand while the users other hand is kept against a palm rest 130, which can be fixed or allowed to rotate with respect to the shaft 122. The rotation of the garbage disposal cleaning device 120 causes the bristles 134 to clean similarly to the first embodiment.

Figure 6:
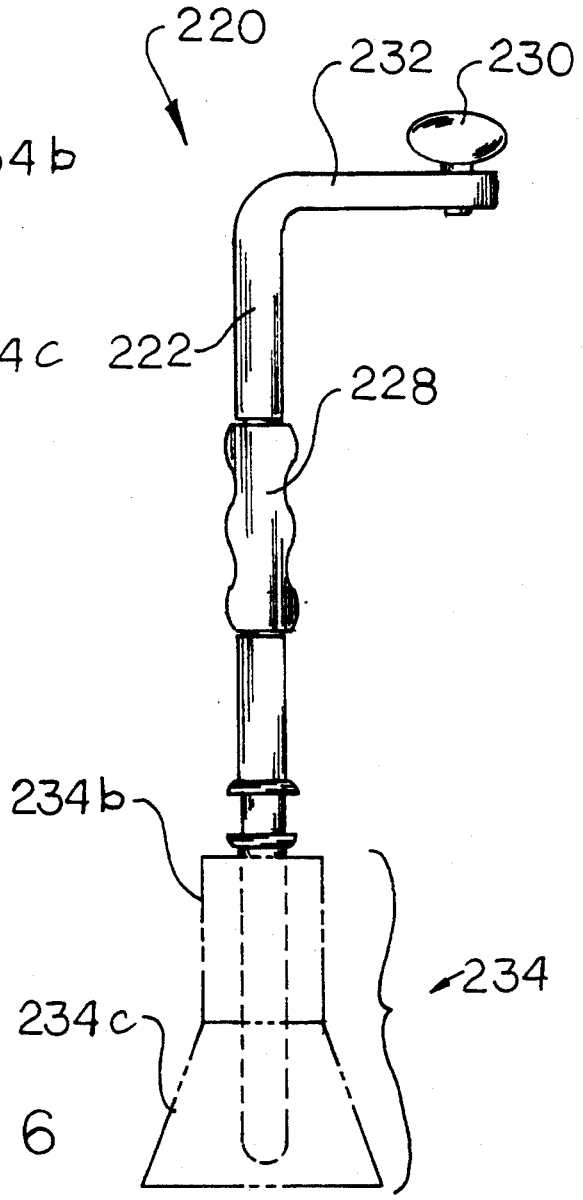
FIG. 6 is a side, partly cross-sectional view of the third preferred embodiment of the garbage disposal cleaning device of the present invention.

A third preferred embodiment of a garbage disposal cleaning device 220 in accordance with the present invention is shown in FIG. 6. The shaft 232 is similar to the first embodiment with a bent portion 232 except that a spin handle 228 like that of the second embodiment is used. Also a spin knob 230 is rotatably fixed to the bent portion 232 of the shaft 222. The combination of the spin knob 230 and the spin handle 228 makes rotation of the garbage disposal cleaning device 220 very easy and effective. Cleaning is accomplished in the same fashion as the first two embodiments. The pattern of the brush bristles 234 is divided into two immediately adjacent sections 234*b* and 234*c*. The first section 234*b* has bristles of the same size while the second section 234*c* has bristles progressively increasing (from top to bottom).

Figures 7, 8:
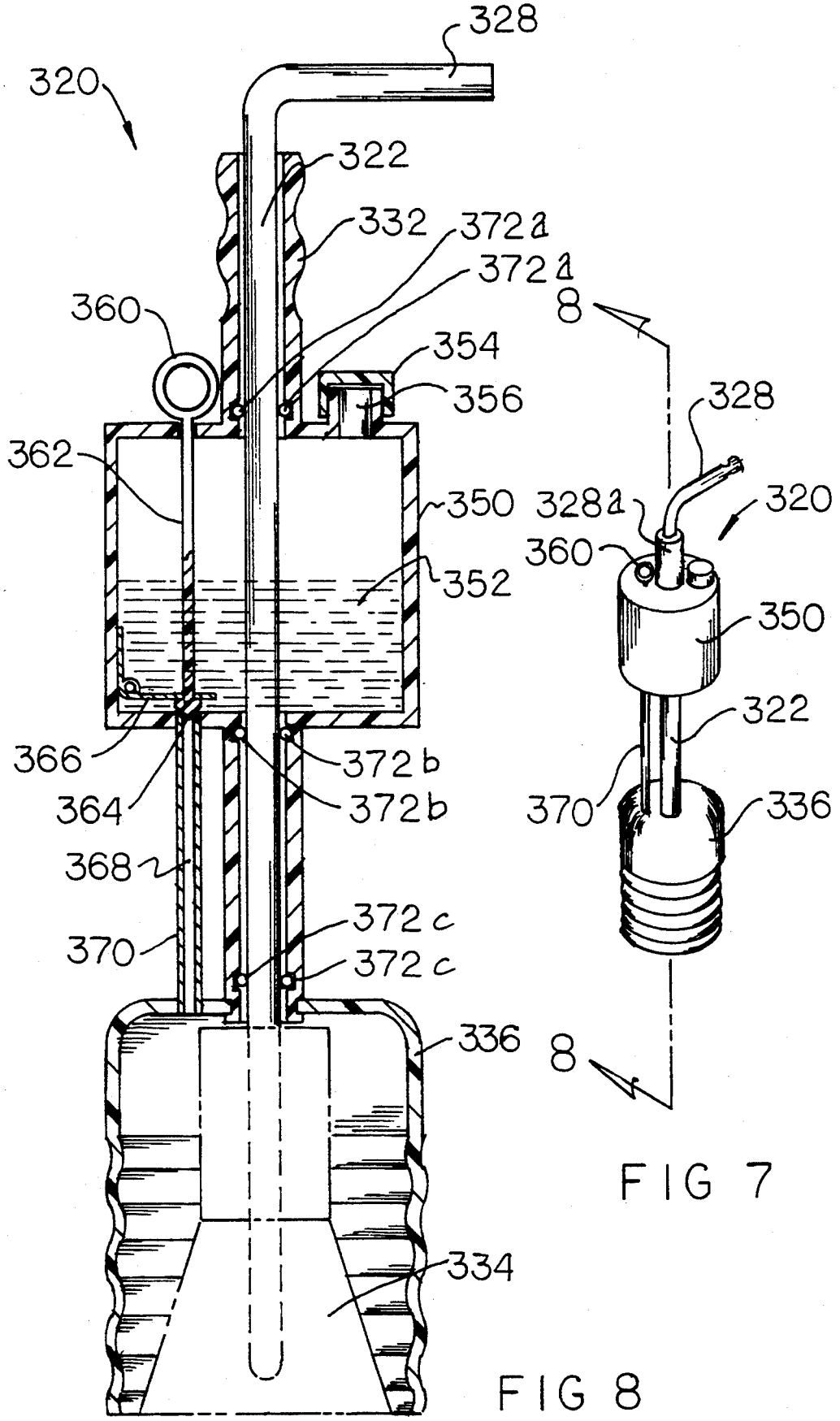
FIG. 7 is a perspective view of the embodiment of FIG. 8 of the garbage disposal cleaning device of the present invention.
FIG. 8 is a side, partly cross-sectional view of the fourth preferred embodiment of FIG. 7 of the garbage disposal cleaning device of the present invention.

The fourth preferred embodiment of the garbage disposal cleaning device 320 of the present invention includes a tank 350 for cleaning fluid/and or disinfectant 352 is shown in FIGS. 7 and 8. The tank 350 is preferably part of a unified structure including the tank 350, a section 332 above the tank and a section 330 below the tank to which the splatter-guard 336 can be either permanently or temporarily fixed. The shaft 322 preferably runs through this unified structure with seals 372*a*, 372*b*, and 372*c* preventing fluid leaks. The shaft has a bent handle 328 like that of the first embodiment, and the upper section 332 can be formed into a hand grip as shown. The bristle pattern 334 preferably used for this embodiment is similar to that of the FIG. 6 embodiment.

The tank can be filled with cleaning fluid and/or disinfectant 352 through fill opening 356 after fill cap 354 is removed. The garbage disposal cleaning device has O-ring seals 372*a*, 372*b*, and 372*c* to prevent the liquid from escaping out the top of the tank (O-ring seal 372*a*), from the tank down into the lower section 330 (O-ring seal 372), and to prevent liquid from coming back up from the splatter guard 336 into the lower section (O-ring seal 372*c*).

In operation, the liquid 352 is dispensed from the tank through dispense passage 368 in dispense tube 370 by pulling a pull ring 360 to open a valve 364 allowing the liquid 352 to dispense. The valve is normally urged closed by a spring 366 which normally forces the valve 364 against the inlet of the dispense tube 370 effectively preventing fluid from escaping from the tank 350 into the dispense passage 368.

The embodiments of the present invention could alternatively use a sponge or other wiping or cleaning means to clean the garbage disposal unit and the walls of the drain instead of a bristle brush. The present invention could also alternatively be used to simply push material to clear out the drain and the garbage disposal unit with the splatter-guard preventing and shielding splatter. The shaft of the present invention could be constructed of any material, although the preferred material would be a molded plastic material because of plastic's relatively inexpensive cost and durability.

It is apparent from the above that the present invention accomplishes all of the objectives set forth by providing a new and improved garbage disposal cleaning device having a foldable/compressible splatter-guard. The handle of the garbage disposal cleaning device can be bent to make rotating the device easier, while the use of semi-soft non-abrasive bristles allows cleaning a garbage disposal unit without abrasive damage. The bristles can be specially contour-shaped to make cleaning of the garbage disposal unit and the surrounding drain more effective.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by LETTERS PATENT of the United States is as follows:

1. A garbage disposal cleaning device comprising:

an elongated shaft having first and second opposed ends;

cleaning means for cleaning a tubular recess below a stationary surface mounted on a portion of said shaft proximal to said second end of said shaft and axially extending toward said first end of said shaft;

a splatter guard mounted on said shaft between said cleaning means and said first end, said splatter guard comprising a housing having a closed end, an opposed open end, and a circumferential flexible skirt extending between said closed end and said open end;

said housing flexible skirt substantially surrounding said cleaning means and said portion of said shaft proximal to said second end upon which said cleaning means is mounted in a radially spaced manner in a first uncompressed condition and being axially and flexibly displaceable toward said first end of said shaft in a second compressed condition thereby to cause said cleaning means and said portion proximal to said second end of said shaft upon which said cleaning means is mounted to axially extend beyond said opposed open end of said splatter guard housing;

said shaft further including retaining means thereon for engaging the closed end of said splatter guard housing so as to cause said flexible skirt to be axially displaced relative to said cleaning means and said second end portion of said shaft upon which said cleaning means is mounted in response to an axially directed force applied against said opposed open end of said splatter guard, said retaining means being located between said closed end of said splatter guard and said first end of said shaft;

further including container means mounted to said handle for storing a fluid substance to facilitate cleaning of a garbage disposal unit, passage means connected between said container means and said splatter guard, and manually activatable means for selectively permitting said fluid substance to flow through said passage means and contact said cleaning means.

2. A garbage disposal cleaning device comprising:

an elongated shaft having first and second opposed ends;

cleaning means for cleaning a tubular recess below a stationary surface mounted on a portion of said shaft proximal to said second end of said shaft and axially extending toward said first end of said shaft;

a splatter guard mounted on said shaft between said cleaning means and said first end, said splatter guard comprising a housing having a closed end, an opposed open end, and a circumferential flexible skirt extending between said closed end and said open end;

said housing flexible skirt substantially surrounding said cleaning means and said portion of said shaft proximal to said second end upon which said cleaning means is mounted in a radially spaced manner in a first uncompressed condition and being axially and flexibly displaceable toward said first end of said shaft in a second compressed condition thereby to cause said cleaning means and said portion proximal to said second end of said shaft upon which said cleaning means is mounted to axially extend beyond said opposed open end of said splatter guard housing;

said shaft further including retaining means thereon for engaging the closed end of said splatter guard housing so as to cause said flexible skirt to be axially displaced relative to said cleaning means and said second end portion of said shaft upon which said cleaning means is mounted in response to an axially directed force applied against said opposed open end of said splatter guard, said retaining means being located between said closed end of said splatter guard and said first end of said shaft;

wherein the portion of said shaft proximal to said first end comprises a handle;

wherein a finger hole is drilled in said handle, whereby said handle can be easily rotated to rotate said cleaning means.

* * * * *